US005691012A

United States Patent [19]

Suchko

[11] Patent Number: 5,691,012

[45] Date of Patent: Nov. 25, 1997

[54] MARKABLE SIGN

[76] Inventor: Allen Suchko, 206 Kestwick Dr., W., Martinez, Ga. 30907

[21] Appl. No.: 577,329

[22] Filed: Dec. 22, 1995

Related U.S. Application Data

[63] Continuation-in-part of Ser. No. 510,319, Aug. 2, 1995.

[51] Int. Cl.[6] ..... G09F 7/04

[52] U.S. Cl. ..... 428/13; 428/100; 428/187; 428/900

[58] Field of Search ..... 428/13, 99, 100, 428/187, 900

[56] References Cited

U.S. PATENT DOCUMENTS

| | | | |
|---|---|---|---|
| 4,231,174 | 11/1980 | Thompson | 428/13 X |
| 4,633,215 | 12/1986 | Anders et al. | 428/100 X |
| 4,944,968 | 7/1990 | Wagner | 428/13 X |
| 4,976,647 | 12/1990 | Axtell | 428/13 X |
| 5,047,267 | 9/1991 | Pantaleo et al. | 428/13 |
| 5,061,540 | 10/1991 | Cripps et al. | 428/100 |
| 5,096,752 | 3/1992 | Wagner | 428/13 |

*Primary Examiner*—Henry F. Epstein
*Attorney, Agent, or Firm*—Laubscher & Laubscher

[57] ABSTRACT

A markable sign is characterized by a laminated structure comprising a flexible layer of backing material having a front surface for receiving permanent printing and a rear surface for mounting on a support object. A flexible transparent layer has a rear surface for receiving permanent printing and a front surface. The transparent layer is connected with the backing layer with the rear surface of the transparent layer preferably being in contiguous relation with the front surface of the backing layer. The front surface of the transparent layer includes two coated areas, one for receiving a permanent marking and the other for receiving an erasable marking. When the sign is mounted on a motor vehicle, information regarding specifications for the vehicle are applied in the form of permanent markings to the first coating and information regarding maintenance performed at regular time intervals can be applied in the form of erasable markings to the second coating.

7 Claims, 3 Drawing Sheets

2

Motor Minder
Suchko's Tire & Brake

Oil Filter Part Number _____
Number of Quarts of Oil _____
Oil Drain Plug Wrench Size _____

Date Oil Changed _____/_____/_____
Mileage at Oil Change _____
Lubricated ___yes ___no
Transmission Fluid Checked ___yes___no
Brake Fluid Checked ___yes ___no
Window Washer Fluid Filled ___ yes ___no
Tire Pressure Checked _____ yes ___no
Other Service Provided _____
_____
_____
Recommended at next service _____
_____

FIG. 1

MARKABLE SIGN

This application is a continuation-in-part of application Ser. No. 08/510,319 filed Aug. 2, 1995.

BACKGROUND OF THE INVENTION

Regular servicing of motor vehicles is necessary to prolong their life and to maintain their dependability, operation, and performance. Unfortunately, too many vehicle owners forget to service their vehicles at the intervals specified by the manufacturer. For example, certain vehicle fluids such as engine oil, coolant, transmission fluid and the like must be changed at regular intervals. In order to assist vehicle owners in keeping track of the service intervals, service facilities provide paper stickers for mounting on the vehicle door frame or plastic stickers for mounting in a corner of the windshield on which the next service interval is indicated.

While the prior stickers are satisfactory, they do possess some drawbacks. First, the stickers are not reusable and thus must be replaced. This presents a problem with the door frame stickers since it is often difficult to remove an outdated sticker from the frame. Moreover, door frame stickers typically have a paper surface which is easily defaced or destroyed by water and the elements, thereby defeating the primary purpose of the sticker.

The plastic windshield stickers also have certain drawbacks. For example, they are unsightly. They also have a tendency to become detached from the windshield, particularly when the inner surface of the windshield is being cleaned. Finally, in order to minimize their size, the windshield stickers can not accomodate a large amount of information.

The present invention was developed in order to overcome these and other drawbacks of the prior stickers by providing a markable sign which can be used repeatedly and which is removably connected with a motor vehicle.

SUMMARY OF THE INVENTION

Accordingly, it is a primary object of the present invention to provide a markable sign including a flexible layer of backing material having a front surface for receiving permanent printing and a rear surface for mounting on a support surface such as a motor vehicle. A flexible transparent layer has a rear surface for receiving permanent printing and a front surface. The transparent layer is connected with the backing layer with the transparent layer rear surface adjacent to the backing layer front surface. A pair of coatings are applied to the transparent layer front surface. One of the coatings is adapted to receive permanent markings and the other coating is adapted to receive erasable markings. When the sign is mounted on a motor vehicle, information regarding specifications for the vehicle can be applied in the form of a permanent marking to the first coating and information regarding maitenance performed at certain time intervals can be applied in the form of an erasable marking to the second coating.

According to another object of the invention, the backing layer is formed of magnetic material for removably mounting the sign on a metal vehicle frame. Alternatively, the backing layer includes hook and pile fasteners for removably mounting the sign.

In an alternate embodiment of the invention, the transparent sheet comprises a side wall portion of a synthetic plastic envelope having an open upper end for receiving the backing layer.

BRIEF DESCRIPTION OF THE DRAWINGS

Other objects and advantages of the invention will become apparent from a study of the foloowing specification when viewed in the light of the accompanying drawing, in which:

FIG. 1 is front plan view of the markable sign according to the invention;

DETAILED DESCRIPTION

Figure 3:
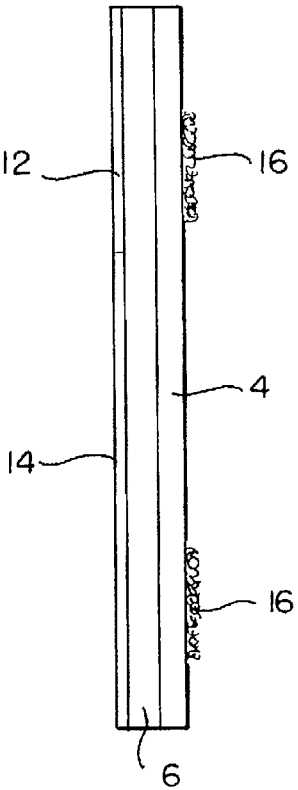
FIG. 3 is a side view of the sign of FIG. 1.
Figure 2:
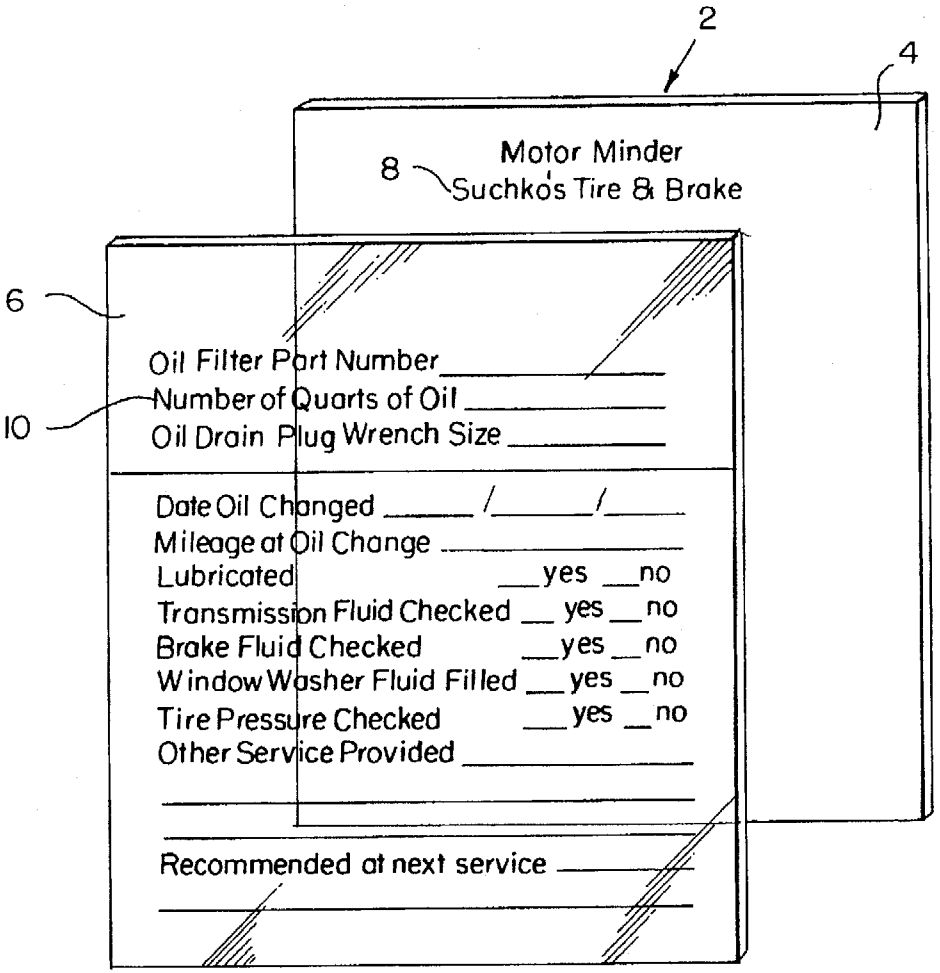
FIG. 2 is an exploded view of the sign of FIG. 1.

The preferred embodiment of the markable sign according to the invention will be described with reference to FIGS. 1–3. The sign 2 comprises two layers, namely a flexible layer of backing material 4 having front and rear surfaces and a flexible layer 6 of transparent synthetic plastic material also having front and back surfaces.

The front surface of the backing layer 4 has permanently printed thereon certain indicia 8 such as the name of the sign and the name of a repair shop where service on the motor vehicle for which the sign is to be used is performed. Because the layer 6 of material is transparent, the indicia 8 on the backing layer can be viewed by the vehicle owner. The rear surface of the transparent layer 6 is also permanently printed with indicia 10 relating to certain specifications for the vehicle as well as to the date and services to be performed on the vehicle.

Printing of the indicia 8, 10 on the backing and transparent layers can be performed by any suitable process such as computer generated imagery, laser printing, photocopying or by a commercial print shop.

The transparent layer 6 is preferably connected with the backing layer 4 with the rear surface of the transparent layer in contiguous relation with the front surface of the backing layer. A thin layer of clear adhesive is preferred for connecting the layers together.

The front surface of the transparent layer 6 preferably includes two different coatings. A first coating 12 is applied to the surface area superimposed over the indicia relating to the specifications of the vehicle. A second coating 14 is applied to the surface area superimposed over the indicia relating to the date and services performed. The first coating 12 is adapted to receive permanent markings and the second coating 14 is adapted to receive erasable markings. That is, on the first coating the vehicle owner can permanently print information relating to the part number of the vehicle's oil and air filters, the crankcase capacity, the oil drain plug size, the preferred tire pressure and the like. On the second coating, the vehicle owner or the service technician can enter the date service was performed, the mileage of the vehicle at the time of service, and the various services performed. At the next service interval, the information from the previous service can be erased and updated with the current service information.

In its preferred form, the backing layer 4 comprises a flexible sheet of magnetic synthetic plastic material. This renders the sign easily connectible with a metal surface of the motor vehicle in any location desired by the vehicle owner, such as on the inner surface of the lid of the trunk. Alternatively, a connecting device such as a hook and pile fastener 16 can be connected with the rear surface of the backing layer as shown in FIG. 3. With either fastener, it is important that the sign be removably connected with the vehicle for ease in making entries on the sign.

Figure 4:
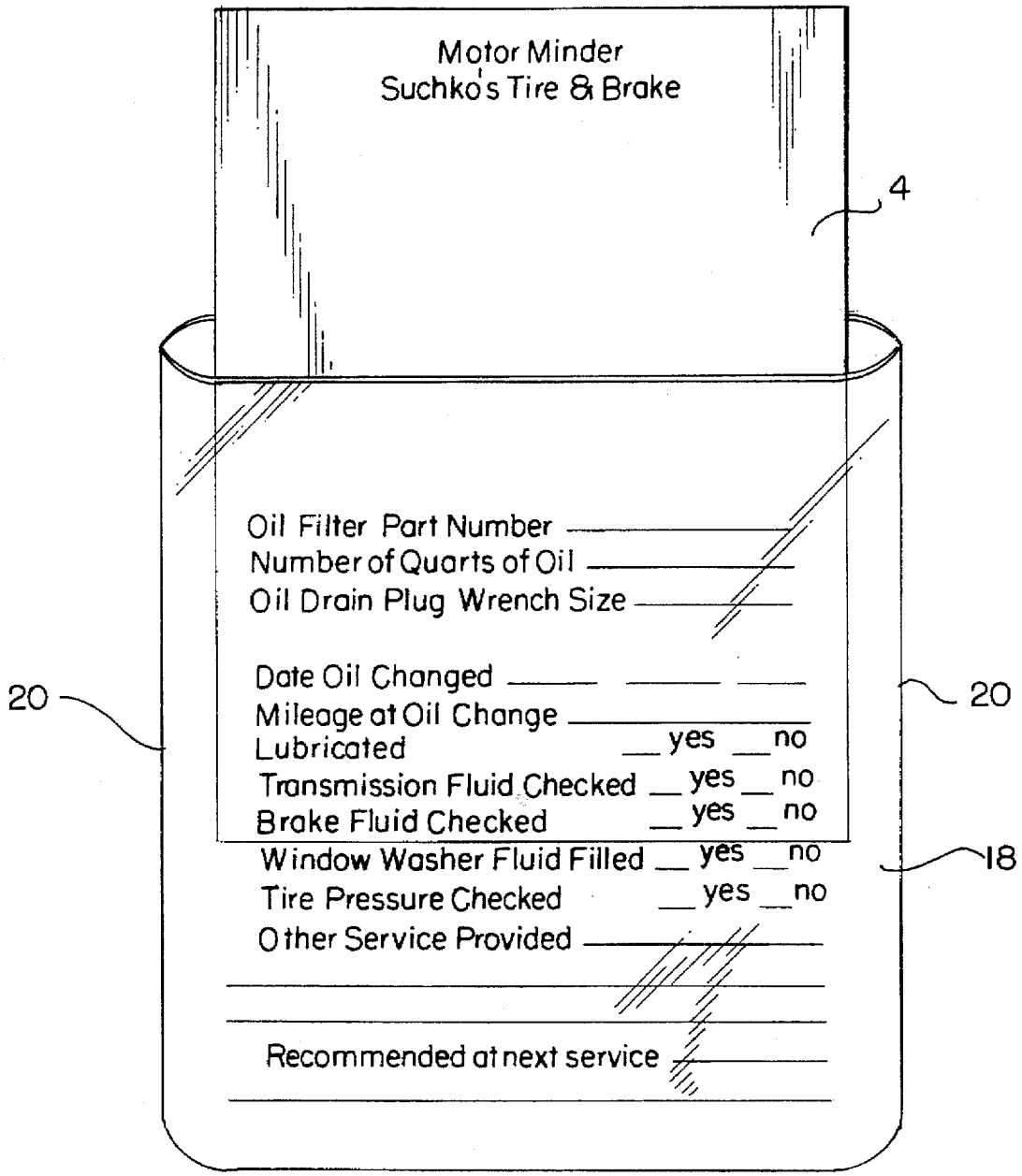
FIG. 4 is a plan view of an alternate embodiment of the markable sign according to the invention.

Referring now to FIG. 4, an alternate embodiment of the invention will be described. In this embodiment, the transparent layer actually comprises a side wall portion of a synthetic plastic envelope 18 having an open upper end for receiving the backing layer 4. The end edges 20 of the envelope serve to press the transparent layer against the backing layer, with the indicia 8 on the backing layer being visible through the transparent layer. The use of the envelope 18 is helpful at the service provider since the envelope can be used to carry a work order. If a non-transparent envelope is used, the transparent layer can be adhesively attached to the outside surface of the envelope.

The multiple laminate feature of the markable sign according to the invention allows printed, graphic or pictorial information to be permanently placed on the front surface of the backing layer and/or on the front and rear surfaces of the transparent layer. Of course, it will be appreciated that a translucent material could be used in place of the transparent layer. It is envisioned that the majority of the signs according to the invention will be based on sheets of flexible magnetic material which are commercially available. With multiple laminated layers, basic data and art work of the sign can be placed on the deepest layer. In addition, logo information and graphics data items that are universal to all of the signs can be placed on the deepest layer (i.e. the backing layer). The transparent layer can also be printed with permanent information. The coatings can be marked with permanent and erasable markings.

While in accordance with the provisions of the Patent Statute the preferred forms and embodiments of the invention have been illustrated and described, it will be apparent to those of ordinary skill in the art that various changes and modifications may be made without deviating from the inventive concepts set forth above.

What is claimed is:

1. A markable sign, comprising (a) a flexible layer of backing material having a front surface for receiving permanent printing and a rear surface for mounting on a support object;

(b) a flexible transparent layer of synthetic plastic material having a rear surface for receiving permanent printing and a front surface;

(c) means for connecting said transparent layer with said backing layer, said transparent layer rear surface being arranged adjacent to said backing layer front surface; and (d) first and second coatings applied to said transparent layer front surface, said first coating being adapted to receive permanent markings and said second coating being adapted to receive erasable markings, whereby when the sign is mounted on a motor vehicle, information regarding specifications for the vehicle can be applied in the form of a permanent marking to said first coating and information regarding maintenance performed at time intervals can be applied in the form of an erasable marking to said second coating.

2. A markable sign as defined in claim 1, and further comprising means connected with said backing layer for removably mounting said backing layer rear surface on said support object.

3. A markable sign as defined in claim 2, wherein said mounting means comprises magnetic material embedded within said backing layer.

4. A markable sign as defined in claim 3, wherein said transparent layer rear surface is arranged in contiguous relation with said magnetic layer front surface.

5. A markable sign as defined in claim 4, wherein said connecting means comprises an adhesive.

6. A markable sign as defined in claim 2, wherein said mounting means comprises a hook and pile fastener.

7. A markable sign as defined in claim 1, wherein said transparent layer comprises a side wall portion of a synthetic plastic envelope having an open upper end for receiving said backing layer, said connecting means comprising end edges of said envelope which press said envelope side wall portion against said backing layer.

* * * * *